US011359456B2

(12) United States Patent
Stolboushkin et al.

(10) Patent No.: US 11,359,456 B2
(45) Date of Patent: Jun. 14, 2022

(54) PLUG WITH A RESETTABLE CLOSURE MEMBER

(71) Applicants: Eugene Stolboushkin, Houston, TX (US); YingQing Xu, Tomball, TX (US); Terry Bussear, Spring, TX (US)

(72) Inventors: Eugene Stolboushkin, Houston, TX (US); YingQing Xu, Tomball, TX (US); Terry Bussear, Spring, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/844,728

(22) Filed: Apr. 9, 2020

(65) Prior Publication Data

US 2021/0238958 A1 Aug. 5, 2021

Related U.S. Application Data

(63) Continuation-in-part of application No. 16/778,859, filed on Jan. 31, 2020.

(51) Int. Cl.

| | |
|---|---|
| ***E21B 34/10*** | (2006.01) |
| ***E21B 34/08*** | (2006.01) |
| ***E21B 33/129*** | (2006.01) |
| ***E21B 43/26*** | (2006.01) |

(52) U.S. Cl.

CPC ..... *E21B 34/10* (2013.01); *E21B 33/129* (2013.01); *E21B 43/26* (2013.01); *E21B 2200/05* (2020.05)

(58) Field of Classification Search

CPC .. E21B 34/102; E21B 33/129; E21B 33/1264; E21B 33/128; E21B 33/12; E21B 33/134; E21B 33/16; E21B 34/08

See application file for complete search history.

(56) References Cited

U.S. PATENT DOCUMENTS

| | | | | |
|---|---|---|---|---|
| 3,298,385 | A * | 1/1967 | Jackson | F16L 37/113 137/112 |
| 4,694,903 | A * | 9/1987 | Ringgenberg | E21B 47/117 166/250.08 |
| 5,209,454 | A * | 5/1993 | Engdahl | F16K 17/363 137/38 |
| 7,484,559 | B2 | 2/2009 | Vert et al. | |
| 7,703,532 | B2 * | 4/2010 | O'Malley | E21B 34/105 166/332.8 |
| 7,845,433 | B2 | 12/2010 | Calderon et al. | |

(Continued)

FOREIGN PATENT DOCUMENTS

| | | | |
|---|---|---|---|
| EP | 1412612 | B1 | 4/2004 |
| WO | 2014203155 | A1 | 12/2014 |
| WO | 2021111347 | A1 | 6/2021 |

OTHER PUBLICATIONS

International Search Report and Written Opinion for PCT Application No. PCT/US2021/015728; dated May 14, 2021; 10 pages.

*Primary Examiner* — Kenneth L Thompson

(74) *Attorney, Agent, or Firm* — Cantor Colburn LLP

(57) ABSTRACT

A plug with a closure member including a body defining a flow bore and a closure member seat, a closure assembly connected to the body, the assembly including a closure member, and a hold open feature to hold the closure member in an open position, the hold open being configured to release the closure member upon a selected hydrodynamic force upon the closure member.

20 Claims, 10 Drawing Sheets

(56) References Cited

U.S. PATENT DOCUMENTS

| | | | | |
|---|---|---|---|---|
| 8,191,634 | B2 * | 6/2012 | Xu | E21B 34/10 166/332.8 |
| 9,163,479 | B2 * | 10/2015 | Rogers | E21B 34/066 |
| 9,309,744 | B2 | 4/2016 | Frazier | |
| 9,909,391 | B2 * | 3/2018 | Girola | E21B 23/02 |
| 10,113,379 | B2 * | 10/2018 | Calderoni | E21B 21/001 |
| 10,132,137 | B2 * | 11/2018 | McDowell | E21B 21/10 |
| 10,337,268 | B2 * | 7/2019 | Girola | E21B 19/16 |
| 10,352,124 | B2 | 7/2019 | Saraya | |
| 10,519,745 | B2 | 12/2019 | Merrill et al. | |
| 10,563,476 | B2 | 2/2020 | Smith et al. | |
| 2009/0071654 | A1 | 3/2009 | O'Malley et al. | |
| 2011/0088908 | A1 * | 4/2011 | Xu | E21B 34/10 166/332.8 |
| 2013/0341034 | A1 * | 12/2013 | Biddick | F16K 1/2007 166/373 |
| 2016/0258259 | A1 | 9/2016 | Walton et al. | |
| 2016/0341002 | A1 * | 11/2016 | McKitrick, III | E21B 34/14 |
| 2017/0159406 | A1 | 6/2017 | Perez | |
| 2021/0238957 | A1 | 8/2021 | Stolboushkin et al. | |
| 2021/0238959 | A1 * | 8/2021 | Stolboushkin | E21B 43/26 |

* cited by examiner

PLUG WITH A RESETTABLE CLOSURE MEMBER

CROSS REFERENCE TO RELATED APPLICATIONS

This application is a continuation-in-part of and claims the benefit of an earlier filing date from U.S. Non-Provisional application Ser. No. 16/778,859 filed Jan. 31, 2020, the entire disclosure of which is incorporated herein by reference.

BACKGROUND

In the resource recovery industry, it is common to set plugs in a borehole environment to allow pressure based operations to be undertaken closer to a pressure source such as a surface location. Examples of such plugs include frac plugs (or packers, and the like) that are set in a borehole to facilitate fracturing a formation uphole of the frac plug. Frac plugs are commonly configured as conical seat structures receptive to a dropped ball for plugging. These work well but require large volumes of pumped fluid to convey balls to their seats and also require that the balls be recirculated back out of the well if a run such as a replacement perf gun is required. Flappers have been tried and successfully reduce pumped fluid requirements but suffer the same drawbacks vis-à-vis the pumping of any component after the flapper has been seated.

SUMMARY

Disclosed is an embodiment of a plug with a closure member including a body defining a flow bore and a closure member seat, a closure assembly connected to the body, the assembly including a closure member, and a hold open feature to hold the closure member in an open position, the hold open being configured to release the closure member upon a selected hydrodynamic force upon the closure member.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
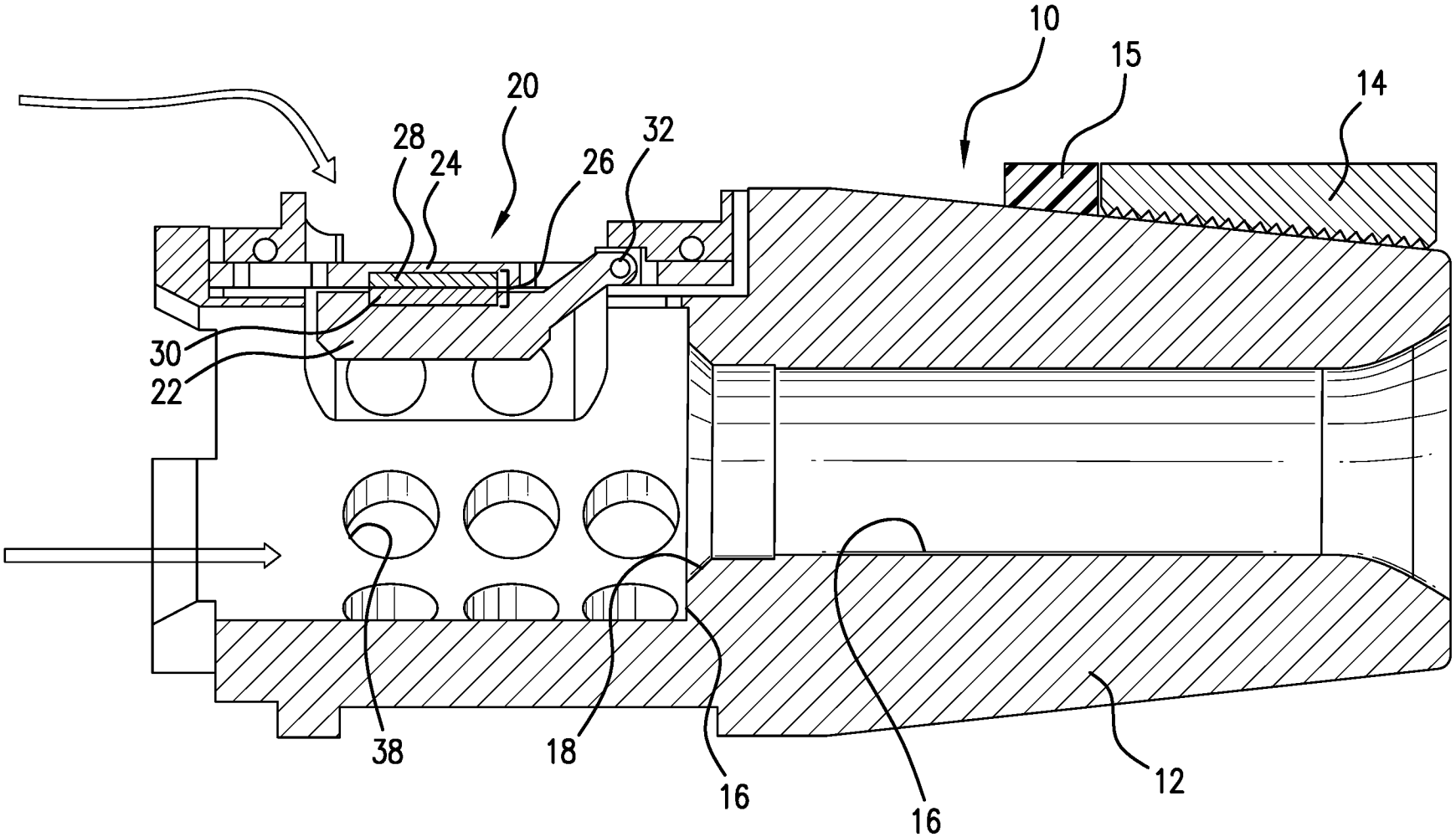
FIG. 1 is a schematic cross-sectional view of a plug with a resettable closure member as disclosed herein.

Referring to FIG. 1, a plug 10 is illustrated. The plug 10 comprises a cone body 12 (that can itself be one or more pieces), slip(s) 14, and seal 15. The plug 10 further comprises a flow bore 16, a closure member seat 18, and a closure member assembly 20.

Closure member assembly 20 is a resettable assembly even while in a borehole in use. In other words, the closure member assembly will hold a closure member 22 in an open position and then allow that member 22 to close responsive to a selected hydrodynamic force. Once the assembly releases the member 22 in response to the selected threshold hydrodynamic force being experienced by the assembly 20, the closure member 22 (illustrated as a flapper) will close against the seat 18. The hydrodynamic force is created by a flow rate (but not below that rate) of a fluid flowing through the flow bore 16 and resetting upon flowback of fluid through the flow bore 16 in the opposite direction (reverse flow). Hereby, the plug 10 may remain open to flow indefinitely while being closable simply by increasing the flow rate to above the selected threshold flow rate whereat the closure member 22 will close against seat 18. Importantly, the plug 10 may also be reopened by the reversed flow and will automatically reset the closure member 22 to its open position prior to having been subjected to the selected threshold flow rate. The closure member 22 will stay that way indefinitely until the flow rate is again raised to beyond the selected rate. The plug is hence resettable any number of times at the whim of the operator without need for pulling the plug from the borehole. This functionality is particularly useful in the case of a fracturing operation. It will be appreciated that occasionally during a frac operation, the perf guns (not shown) fail to discharge. In such condition the guns must be withdrawn from the borehole and new guns pumped in. In prior art systems, the pumping back in is not possible if the frac plug is closed. Without fluid flow through the frac plug, the guns may not be pumped to position. Accordingly, plugs of the prior art must be removed altogether or at least the ball on seat would need to be flowed out of the well before new guns could be pumped into place. The plug 10 allows replacement of guns without need for ancillary activities. The plug 10 will automatically reset itself upon pulling of the guns since the attendant flowback of fluid through the plug 10 will push the closure member 22 off seat 18 and flow it back toward its fully open position whereat it will be automatically secured.

Figure 2:
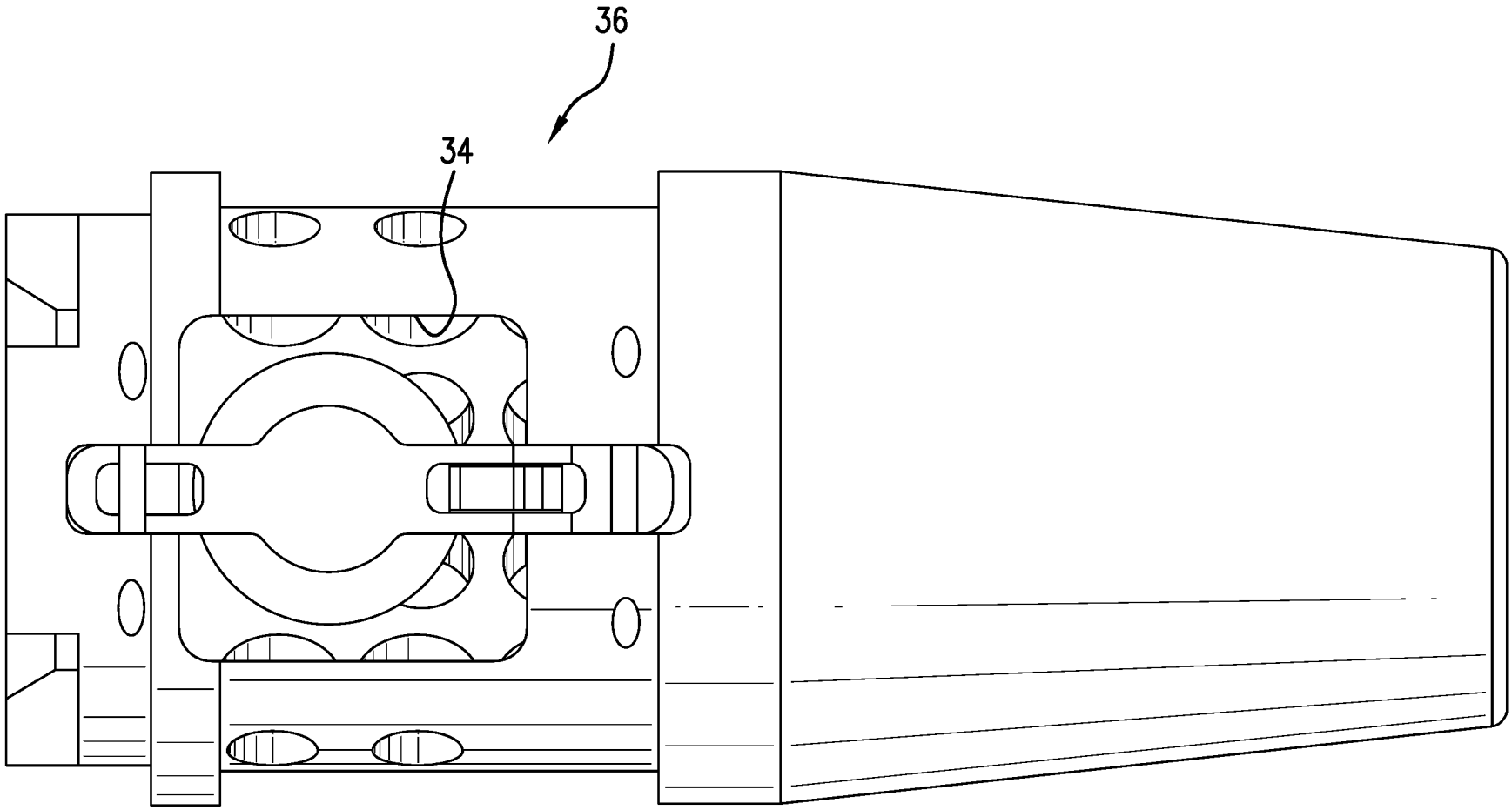
FIG. 2 is a view of the plug illustrated in FIG. 1 rotated 90 degrees.

The assembly 20 includes a frame 24 (which may be a separate member or a part of the cone body 12 itself) and a magnetic catch 26 (a hold open feature). In one embodiment the magnetic catch 26 comprises two magnets 28 and 30 that are attractively interactive with each other. As illustrated magnet 28 is mounted on the frame 24 and magnet 30 is mounted on the closure member 22 and they are aligned with one another when the closure member 22 is in the open position. It will be appreciated that movement of the closure member 22 is pivotal, dictated by pivot pin 32 and so the magnets 28 and 30 will be aligned and attracted to one another when brought near one another through pivotal movement of the closure member 22 toward the open position. In alternate embodiments, either of 28 or 30 may be substituted by a magnetically permeable material such as a ferrous member. Referring to FIG. 2 along with FIG. 1 now, it is to be appreciated that an actuation opening 34 exists in the cone body 12. It will be appreciated by those of skill in the art that fluid flowing from a left of the figure will flow around and outside of the uphole end 36 of the cone body 12 and then through the opening 34 as well as through the flow bore 16 (see double arrows in FIG. 1). The fluid flowing through the opening 34 hydrodynamically loads the closure member 22. At a selected flow rate, the hydrodynamic load will exceed the holding capability of the magnetic catch 26 and cause the closure member 22 to pivot to a seated position against seat 18. In an embodiment, the magnetic catch is set to hold 16 lbs of load and that equates to 15 barrels per minute flow rate. Therefore, any operation below 15 barrels per minute (BPM) may progress without the member 22 closing but at a rate of greater than 15 BPM, the member 22 will close. It is to be understood that the flow rate noted is for water at ambient surface temperature. If the temperature is higher, the rate will need to be higher to compensate for the lower density of the water. Alternatively, if the flow is of a downhole fluid, the density may be higher and accordingly the flow rate of such fluid may be lower yet still be sufficient to cause the magnetic catch 26 to release the closure member 22.

It should be appreciated that the figures also illustrate holes 38 (one or more of them) in the cone body 12. These holes reduce the hydrodynamic force upon the closure member 22 relative to a cone body that does not include these holes 38. Both embodiments are contemplated so that greater latitude in adjusting for desired flow rate and/or accounting for type of working fluid is available.

Figure 3:
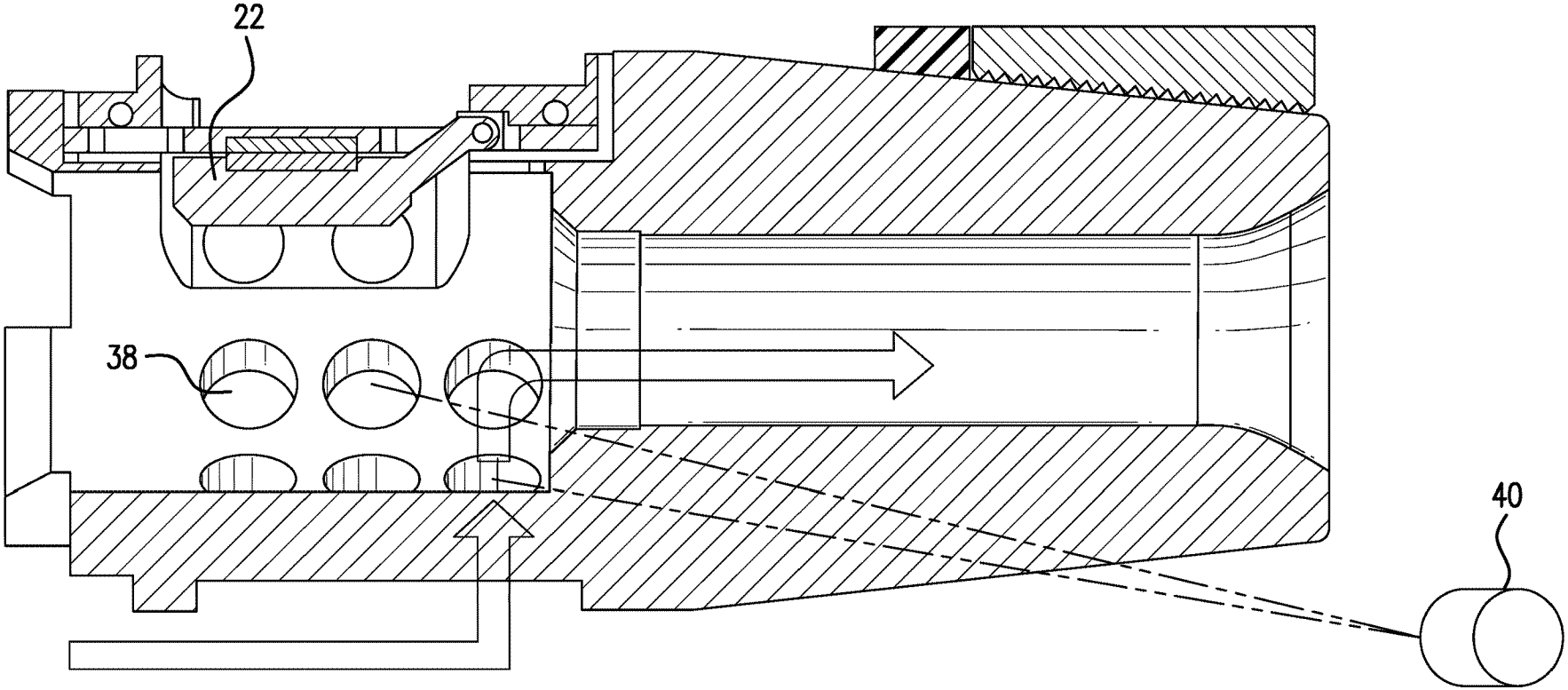
FIG. 3 illustrates another feature of FIG. 2.

In another embodiment, referring to FIG. 3, the image is different from FIG. 2 in that a plug member 40 is illustrated. The plug member 40 is schematically illustrated. It is to be appreciated that the plug member 40 may be a friction fit type surface, a threaded surface, etc. The plug member 40 may be one or more of them and may be installed into the holes 38. The operator may elect to use one or more of the plug members 40 to adjust the hydrodynamic force that is developed on the closure member 22, the more plug members 40 the greater the aggregate hydrodynamic force that will act on the closure member 22 from fluid flowing through the opening 34 since reduced fluid flow through holes 38 results in a reduction in the counteracting hydrodynamic force that is created by fluid flowing radially inwardly through the holes 38. Plug members 40 may be installed in the manufacturing process or on site as desired or required enhancing adjustability of the plug 10.

Figure 4:
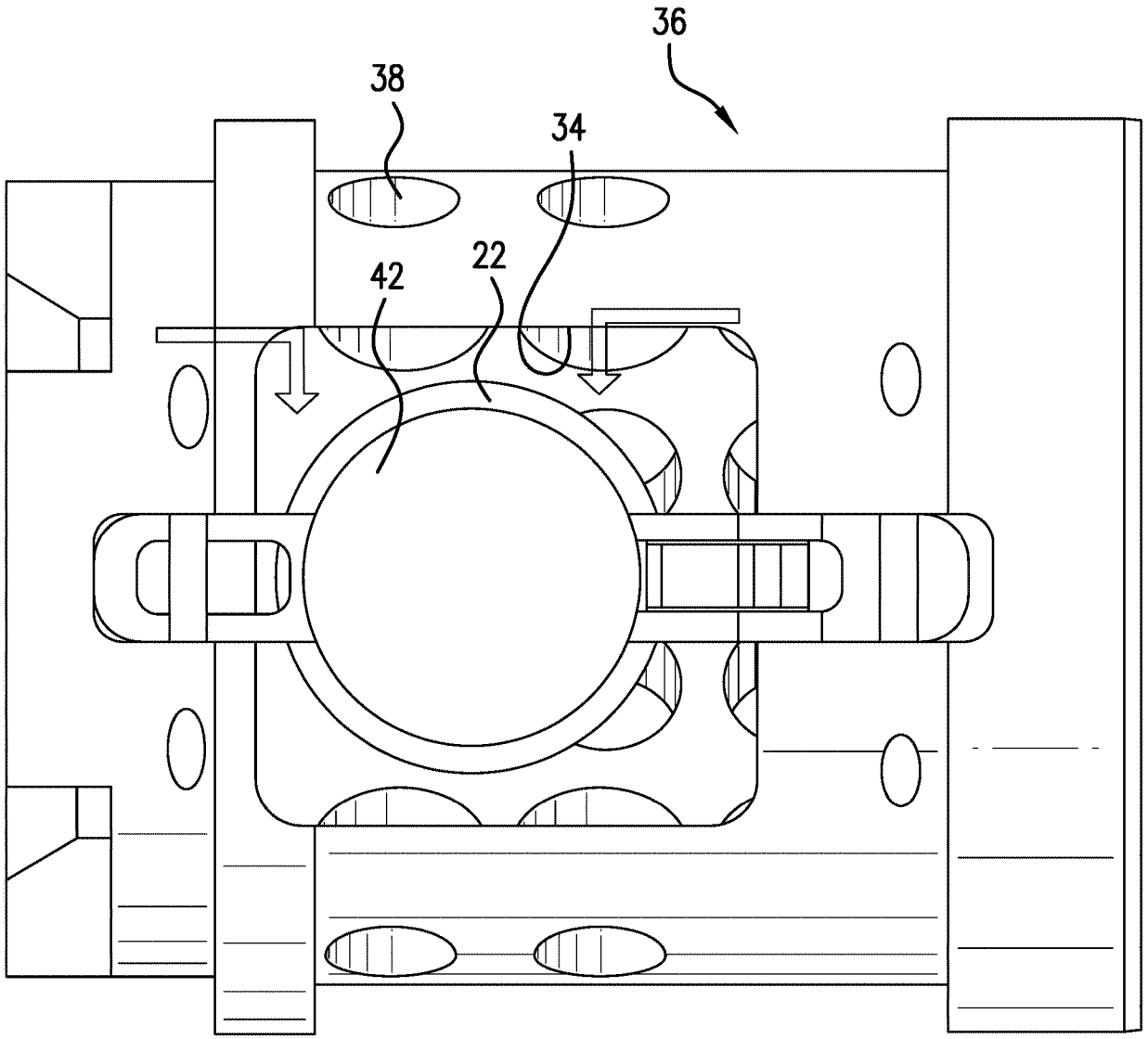
FIG. 4 illustrates another feature of FIG. 2.

Referring to FIG. 4, another feature employable alone or in combination to control the hydrodynamic force on the closure member 22 is a cover 42. Cover 42 depending upon its area, shields more or less of the closure member 22 from fluid flowing through the opening 34. The less area of closure member 22 that is shielded by cover 42, the higher the hydrodynamic force on the closure member from fluid flowing radially inwardly through the opening 34. Of course, the reverse is also true, to wit: The greater the area of closure member 22 that is shielded by cover 42, the lesser the hydrodynamic force on the closure member from fluid flowing radially inwardly through the opening 34. Cover 42 may be installed in the manufacturing process or on site as desired or required enhancing adjustability of the plug 10.

Figure 5:
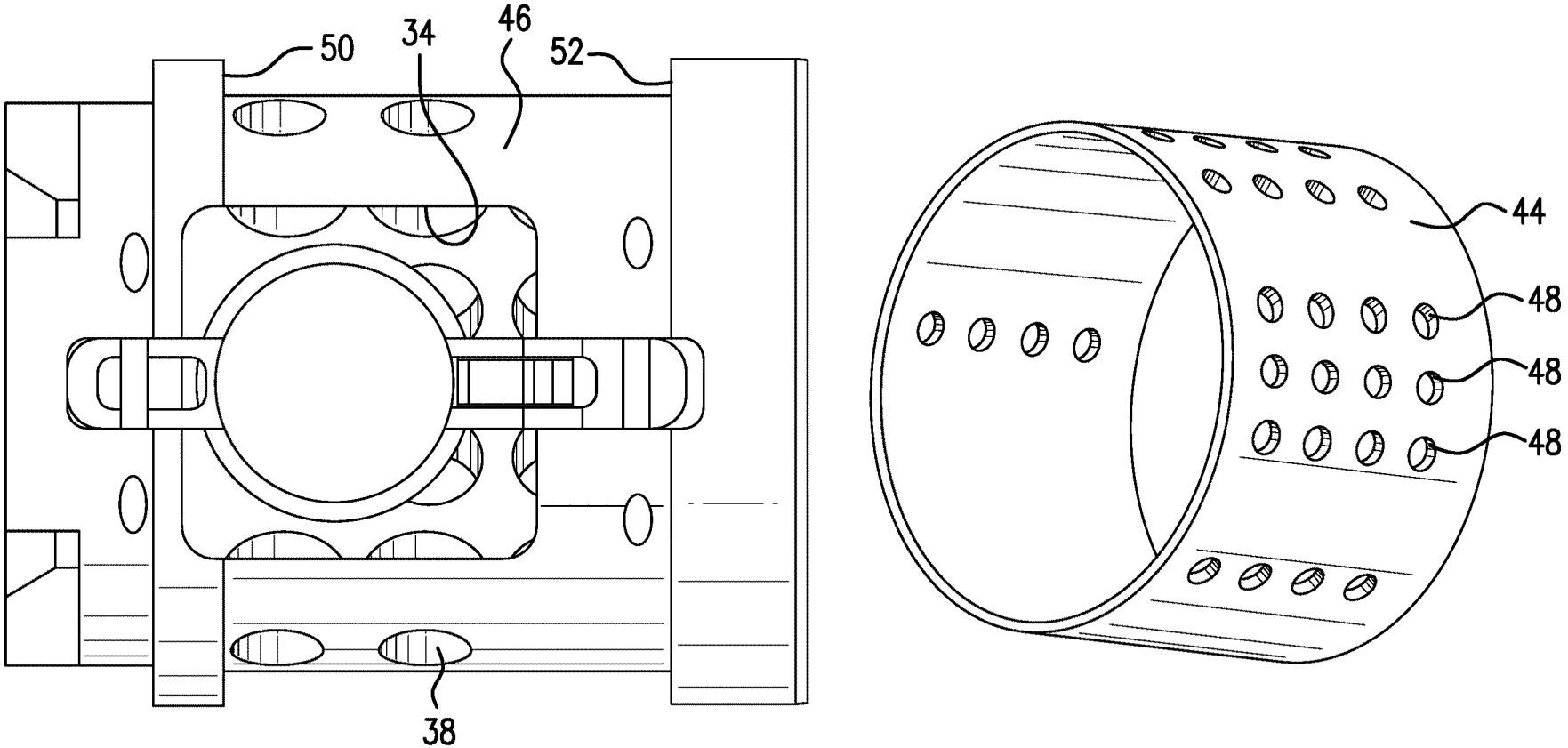
FIG. 5 illustrates another feature of FIG. 2.
Figure 6:
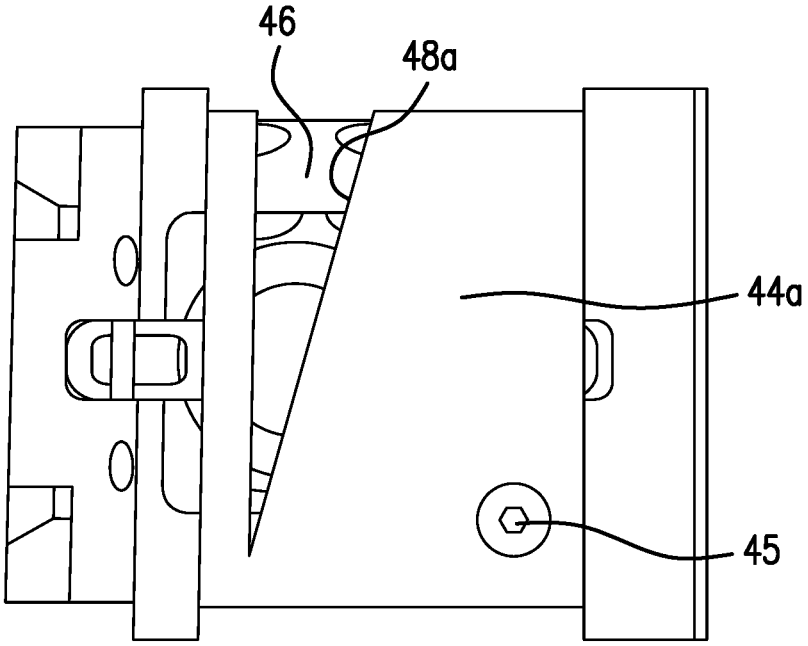
FIG. 6 illustrates an alternative feature of FIG. 2.
Figure 7:
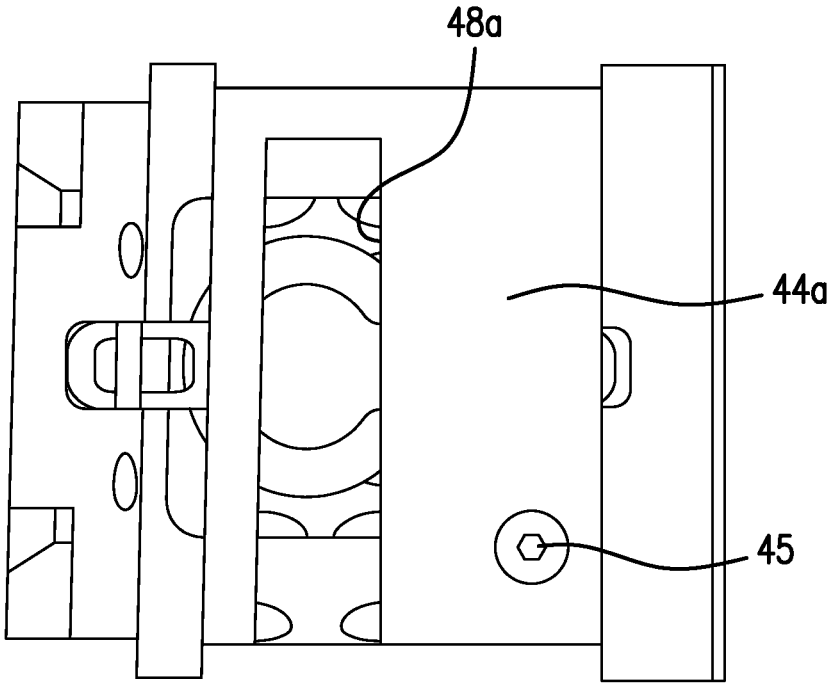
FIG. 7 illustrates another position for the alternative feature of FIG. 2

Referring to FIG. 5-7, one exposed to the foregoing will recognize a portion of the plug 10 illustrated (in FIG. 1) and appreciate that an adjusting sleeve 44 is illustrated exploded from its seat area 46. It is to be appreciated that the adjusting sleeve 44 is to be disposed on its seat area 46 during use and may be placed there during manufacture of the plug 10 or may be placed there on site. The adjusting sleeve 44 is rotatable about the seat area 46 so that one or more ports 48 may be rotationally aligned or misaligned with one or more holes 38 and/or opening 34 of the plug 10. Alignment and misalignment may be complete or partial so that line adjustment of hydrodynamic forces acting on the closure member 22 as discussed above is possible simply by rotating the adjusting sleeve 44. The sleeve 44 is maintained in position axially by shoulders 50 and 52 which may be a part of the plug 10 at the time of manufacture (whereby the sleeve 44 would need to be installed at that time) or may be separate fastenable structures to be assembled in the field such as split shaft collars, threaded collars, collars with radial screws, welded on collars, etc. An alternate sleeve configuration with a wedge shaped port 48*a* is illustrated at 44*a* in FIGS. 6 and 7 along with a set screw 45 that may be employed in either embodiment.

It is also to be appreciated that the assembly 20 or any of the other features disclosed herein in any combination may be installed upon any kind of plug by providing a housing for the assembly 20 and then connecting that housing to a plug by threading, welding, friction fit, etc.

Figure 8:
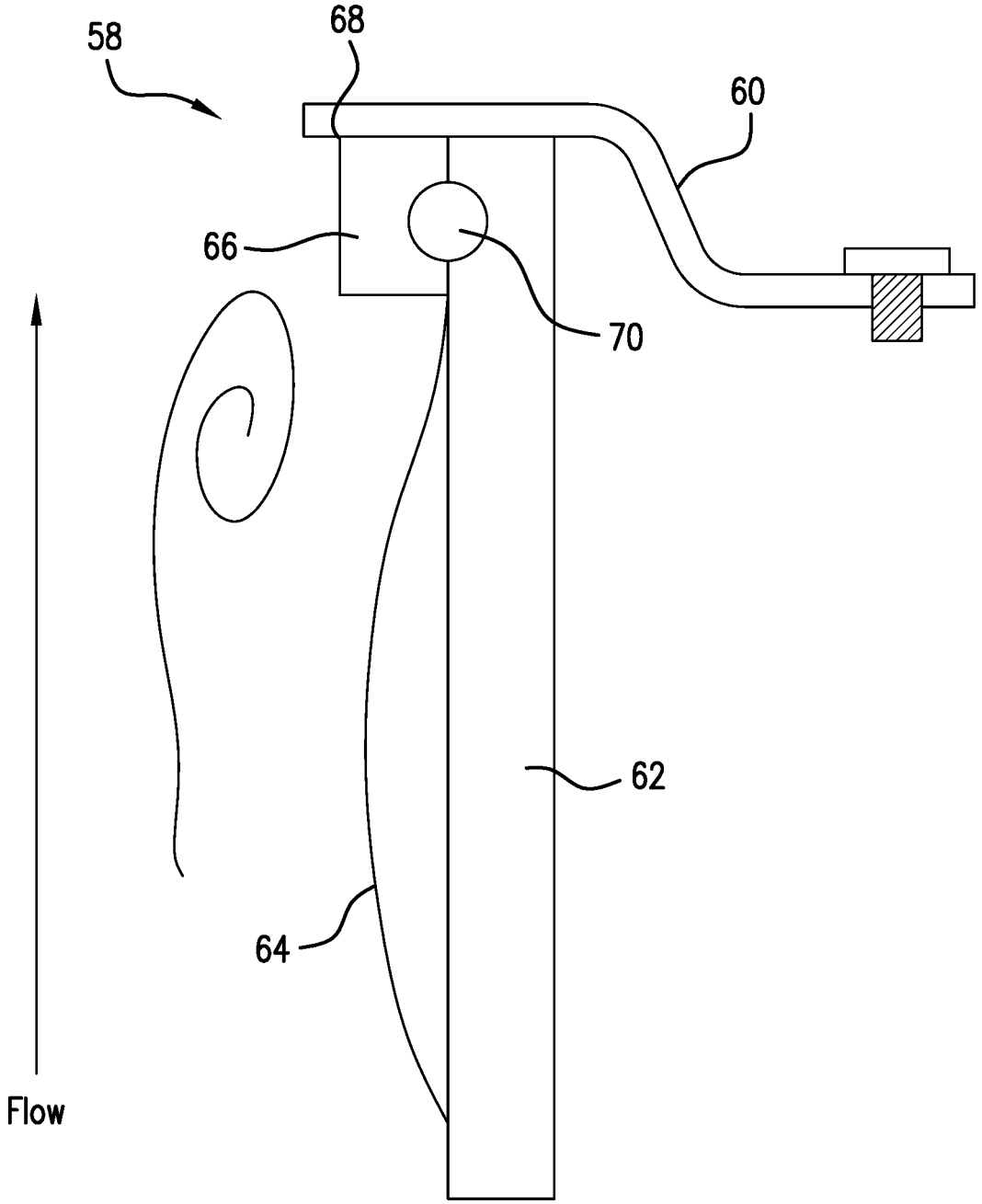
FIG. 8 illustrates an alternative arrangement of the closure member for all embodiments in an open position.
Figure 9:
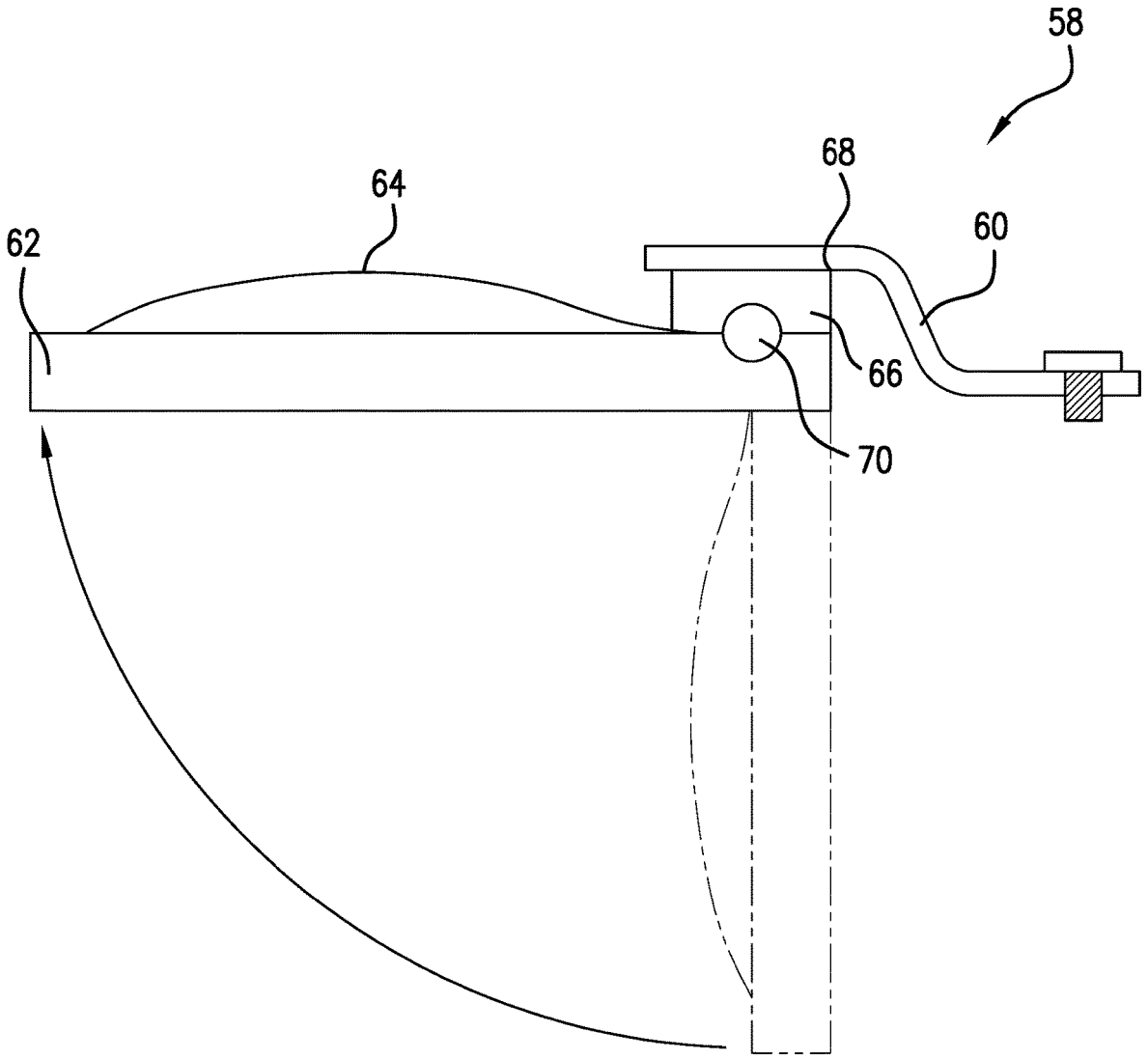
FIG. 9 illustrates the alternative arrangement of the closure member of FIG. 8 in a closed position.
Figure 10:
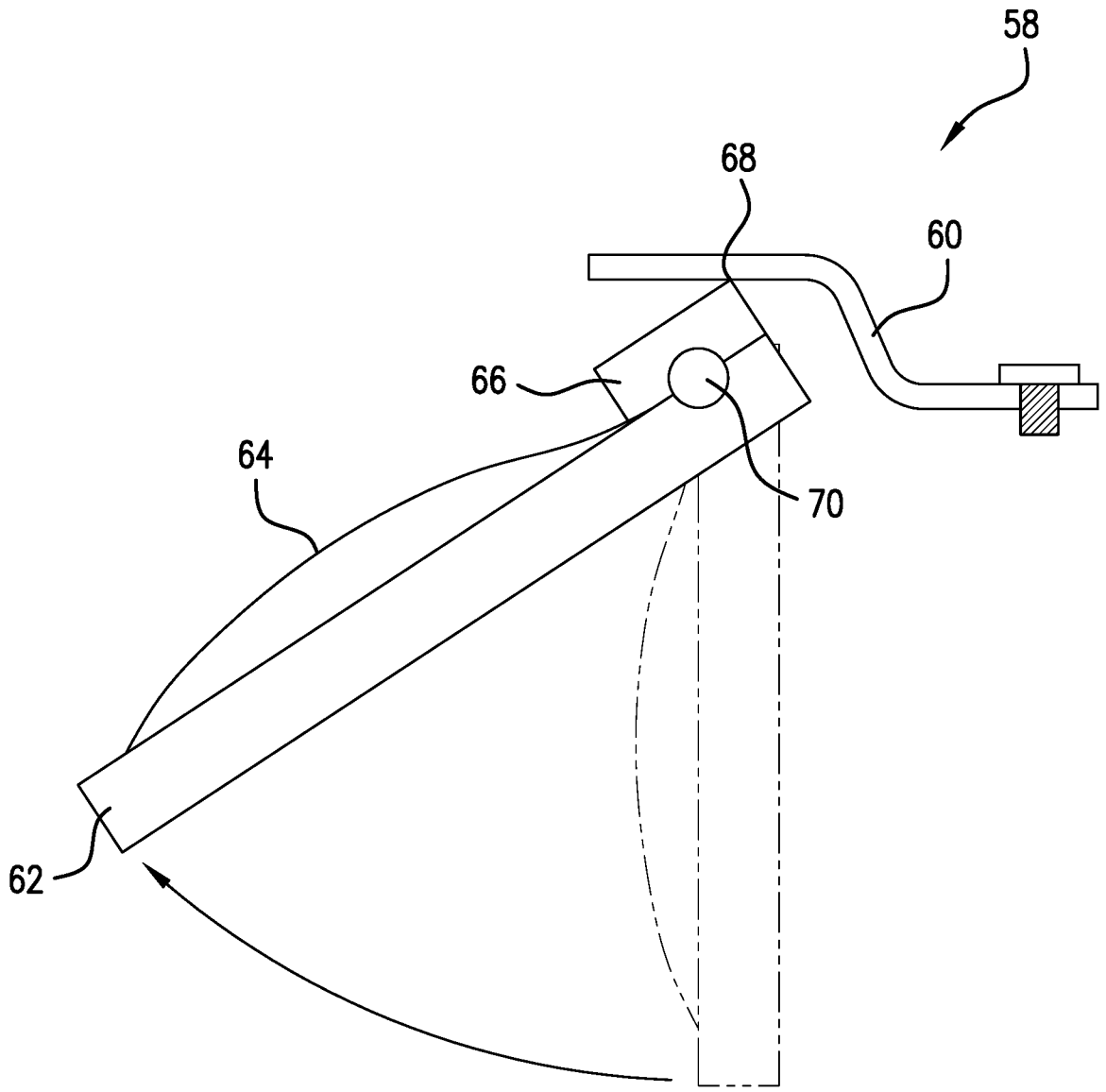
FIG. 10 illustrates the alternative arrangement of the closure member of FIG. 8 in an intermediate position between that of FIG. 6 and FIG. 7.

In addition to assembly 20 that is maintained selectively in the open position by a magnetic field, it is also contemplated by the inventors hereof that a similar assembly 58 employing a hold open feature 60 such as a spring may be employed instead of the magnetic arrangement (see FIGS. 8, 9, and 10). The hold open feature 60 may be any biasing configuration that is biased to hold the closure member open such as a torsion spring, clock spring, lever spring, coil spring, gas spring, etc. A spring from a safety valve flapper could be used if assembled oppositely to a common assembly for a safety valve to hold the closure member open rather than closed as would be the case in a safety valve. This assembly 58 comprises a hold open spring 60 configured to hold a closure member 62 open against hydrodynamic forces up to a selected threshold hydrodynamic force similar to the foregoing so that certain flow rates are possible without closing the member 62 while at rates above that threshold the member 62 will close. When the hydrodynamic force rises above a threshold force due to fluid flow rate through the plug 10, the closure member 62 will be forced closed. The hydrodynamic force on the member 62 may be applied thereto identically to the foregoing embodiments or may be added to or substituted by a venturi effect. If a strong venturi effect is desired, a surface 64 of the member 62 exposed to the fluid flow in the borehole the plug 10 may be profiled as a wing to encourage lift on the member 62 in the desired direction (closing) to overcome the hold open capability of the spring 60. After closure member 62 is closed, the fluid pressure thereagainst in the closing direction will also keep the closure member 62 closed. Upon release of that fluid pressure however, the hold open spring will reset the member 62 to the open position. In another variation of this embodiment, still referring to FIGS. 8-10, the closure member 62 may be arranged to be retained in not only the open position but the closed position as well. The closure member 62 in this variation is urged to the open position or to the closed position depending upon where in the range of positions the member 62 is. More specifically, attention is directed to cam member 66. A portion of the cam member 66 is arranged as a peak 68 with regard to distance from a center axis of a rotation pin 70. When the closure member 62 is midway between open and closed, the peak 68 has maximally deflected spring 60. Accordingly, as the member 62 moves in either direction from this maximal deflection, the bias of the spring 60 will assist the closure member 62 to an end point, i.e. open or closed. Hydrodynamic force in either flow direction when of sufficient magnitude will overcome the spring bias and release the closure member toward its other end position.

Figure 11:
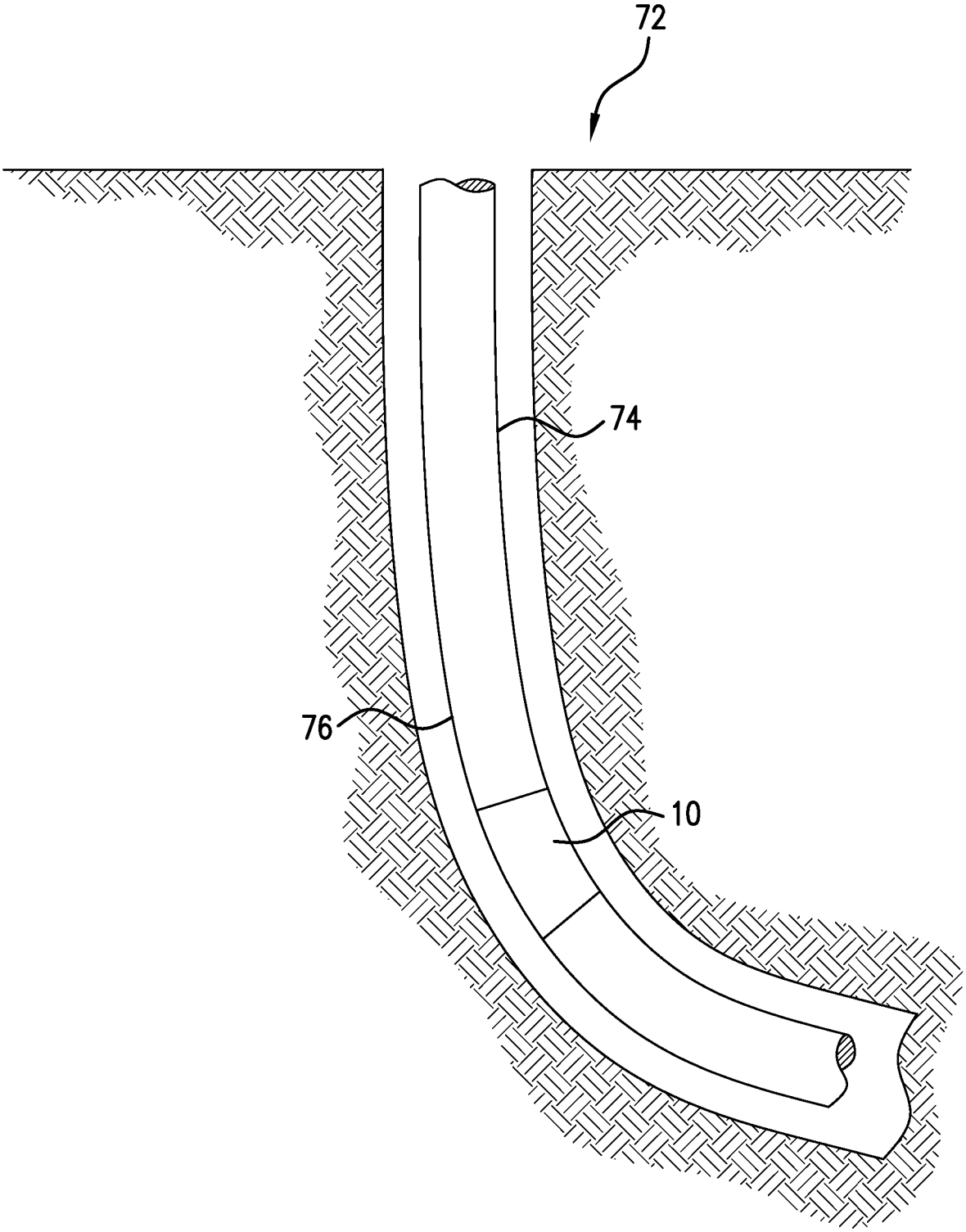
FIG. 11 is a schematic view of a wellbore system having the plug of FIG. 1 disposed therein.

Referring to FIG. 11, a wellbore system 72 includes a borehole 74, a string 76 disposed in the borehole 74 and a plug 10 disposed in the string. The wellbore system 72 may include multiple plugs 10 therein.

Set forth below are some embodiments of the foregoing disclosure:

Embodiment 1: A plug with a closure member including a body defining a flow bore and a closure member seat, a closure assembly connected to the body, the assembly including a closure member, and a hold open feature to hold the closure member in an open position, the hold open being configured to release the closure member upon a selected hydrodynamic force upon the closure member.

Embodiment 2: The plug as in any prior embodiment wherein the closure member is resettable.

Embodiment 3: The plug as in any prior embodiment wherein the hold open feature is a magnetic catch.

Embodiment 4: The plug a as in any prior embodiment wherein the hold open feature is a spring.

Embodiment 5: The plug as in any prior embodiment further comprising a hole in the body.

Embodiment 6: The plug as in any prior embodiment wherein the hole is receptive to a plug member.

Embodiment 7: The plug as in any prior embodiment wherein the plug member is threaded.

Embodiment 8: The plug as in any prior embodiment further comprising an adjusting sleeve having a port, the sleeve movably supported on the body to align or misalign the port with the hole for an opening.

Embodiment 9: The plug as in any prior embodiment further comprising a cover disposed to reduce an area of the closure member subject to the hydrodynamic force.

Embodiment 10: The plug as in any prior embodiment further including a slip and seal.

Embodiment 11: The plug as in any prior embodiment wherein the closure assembly further includes a frame and a magnet disposed on the frame or on the closure member or on both.

Embodiment 12: The plug as in any prior embodiment wherein the closure member includes a surface thereon profiled to promote lift on the closure member during fluid flow past the surface.

Embodiment 13: The plug as in any prior embodiment wherein the closure member is a flapper.

Embodiment 14: The plug as in any prior embodiment wherein the plug is a frac plug.

Embodiment 15: A method for fracturing a wellbore system including flowing a fluid through a plug as in any prior embodiment, exceeding a selected flow rate associated with release of the closure member to seat on the closure seat.

Embodiment 16: The method as in any prior embodiment further comprising resetting the closure member by flowing fluid through the body in an opposite direction during closure of the closure member.

Embodiment 17: The method as in any prior embodiment wherein the resetting is resetting a magnetic catch with the closure member in the open position.

Embodiment 18: The method as in any prior embodiment wherein the resetting the magnetic catch is automatic upon flowing the closure member into proximity with the frame.

Embodiment 19: The method as in any prior embodiment wherein the resetting is by a hold open spring urging the closure member to the open position.

Embodiment 20: A wellbore system including a borehole, a plug as in any prior embodiment disposed in the borehole.

Embodiment 21: The system as in any prior embodiment wherein the closure member is resettable while in the borehole.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A plug with a closure member comprising:

a body defining a flow bore and a closure member seat;

a closure assembly connected to the body, the assembly including:

a closure member; and a hold open feature to hold the closure member in an open position, the hold open being configured to release the closure member upon a selected hydrodynamic force upon the closure member, further comprising a cover disposed to reduce an area of the closure member subject to the hydrodynamic force.

2. The plug as claimed in claim 1 wherein the closure member is resettable.

3. The plug as claimed in claim 1 wherein the hold open feature is a magnetic catch.

4. The plug as claimed in claim 1 wherein the hold open feature is a spring.

5. The plug as claimed in claim 1 further comprising a hole in the body.

6. The plug as claimed in claim 5 wherein the hole is receptive to a plug member.

7. The plug as claimed in claim 6 wherein the plug member is threaded.

8. The plug as claimed in claim 1 further including a slip and seal operably connected to the body.

9. The plug as claimed in claim 1 wherein the closure assembly further includes a frame and a magnet disposed on the frame or on the closure member or on both.

10. The plug as claimed in claim 1 wherein the closure member includes a surface thereon profiled to promote lift on the closure member during fluid flow past the surface.

11. The plug as claimed in claim 1 wherein the closure member is a flapper.

12. The plug as claimed in claim 1 wherein the plug is a frac plug.

13. A plug with a closure member comprising:

a body defining a flow bore, a closure member seat and a hole in the body;

a closure assembly connected to the body, the assembly including:

a closure member; and a hold open feature to hold the closure member in an open position, the hold open being configured to release the closure member upon a selected hydrodynamic force upon the closure member further comprising an adjusting sleeve having a port, the sleeve movably supported on the body to align or misalign the port with the hole or an opening.

14. A method for fracturing a wellbore system comprising:

flowing a fluid through a plug as claimed in claim 1;

exceeding a selected flow rate associated with release of the closure member to seat on the closure seat.

15. The method as claimed in claim 14 further comprising resetting the closure member by flowing fluid through the body in an opposite direction during closure of the closure member.

16. The method as claimed in claim 15 wherein the resetting is resetting a magnetic catch with the closure member in the open position.

17. The method as claimed in claim 15 wherein the resetting the magnetic catch is automatic upon flowing the closure member in the opposite direction.

18. The method as claimed in claim 15 wherein the resetting is by a hold open spring urging the closure member to the open position.

19. A wellbore system comprising:

a borehole;

a plug as claimed in claim 1 disposed in the borehole.

20. The system as claimed in claim 19 wherein the closure member is resettable while in the borehole.

* * * * *